US011335318B2

(12) United States Patent
Krumins et al.

(10) Patent No.: US 11,335,318 B2
(45) Date of Patent: May 17, 2022

(54) ELECTRONIC EFFECTS DEVICE AND METHOD

(71) Applicant: Gamechanger Audio SIA, Riga (LV)

(72) Inventors: Ilja Krumins, Riga (LV); Martins Melkis, Riga (LV); Kristaps Kalva, Plavinas (LV)

(73) Assignee: Gamechanger Audio SIA, Riga (LV)

( * ) Notice: Subject to any disclaimer, the term of this patent is extended or adjusted under 35 U.S.C. 154(b) by 106 days.

(21) Appl. No.: 15/733,331

(22) PCT Filed: Jan. 4, 2019

(86) PCT No.: PCT/IB2019/050069

§ 371 (c)(1),
(2) Date: Jun. 29, 2020

(87) PCT Pub. No.: WO2019/135196

PCT Pub. Date: Jul. 11, 2019

(65) Prior Publication Data

US 2020/0357380 A1 Nov. 12, 2020

Related U.S. Application Data

(60) Provisional application No. 62/613,809, filed on Jan. 5, 2018.

(51) Int. Cl.

| | |
|---|---|
| ***G10H 1/12*** | (2006.01) |
| ***G10K 15/06*** | (2006.01) |
| ***G10H 3/18*** | (2006.01) |

(52) U.S. Cl.
CPC ..... *G10K 15/06* (2013.01); *G10H 1/12* (2013.01); *G10H 3/187* (2013.01); *G10H 2210/305* (2013.01); *G10H 2210/311* (2013.01)

(58) Field of Classification Search
CPC ..... G10H 2210/305; G10H 2210/311; G10H 3/187; G10H 1/043; G10H 1/42; G10H 2250/305; G10H 1/18; G10H 1/00; G10H 5/02; G10H 1/22; G10H 2220/311; G10H 5/00; G10H 5/16; H01J 37/3244; H01J 2893/0061; G10K 15/06
See application file for complete search history.

(56) References Cited

U.S. PATENT DOCUMENTS 1,936,922 A 11/1933 Sukumlyn
3,022,696 A 2/1962 Dorf
(Continued)

FOREIGN PATENT DOCUMENTS

CN 101820573 A 9/2010
JP S4613068 Y1 5/1971
(Continued)

*Primary Examiner* — Marlon T Fletcher
(74) *Attorney, Agent, or Firm* — Smartpat PLC

(57) ABSTRACT

An electronic effects device comprising: an input circuit for receiving an input audio signal; a gas discharge tube in communication with the input circuit; wherein the input circuit comprises a transducer for converting the input signal into a signal suitable for producing a discharge in the gas discharge tube; an output circuit in communication with the gas discharge tube for converting the gas discharge into an output signal. A corresponding method for producing electronic effects for musical instruments is also described.

12 Claims, 5 Drawing Sheets

(56) References Cited

U.S. PATENT DOCUMENTS

| | | | | | |
|---|---|---|---|---|---|
| 3,147,334 | A * | 9/1964 | White | G10H 1/043 84/706 |
| 4,353,008 | A * | 10/1982 | Dorfman | A63J 17/00 315/114 |
| 5,333,203 | A * | 7/1994 | Diaz | H03G 5/10 381/62 |
| 2007/0017345 | A1 * | 1/2007 | Stoneback | G10H 5/14 84/600 |
| 2019/0319591 | A1 * | 10/2019 | Anderson | H03F 3/45475 |
| 2020/0357380 | A1 * | 11/2020 | Krumins | G10K 15/06 |

FOREIGN PATENT DOCUMENTS

| | | | | |
|---|---|---|---|---|
| JP | S5167735 | A | 6/1976 | |
| JP | 2000111604 | A | 4/2000 | |
| RU | 2496254 | C1 | 10/2013 | |
| WO | WO-2019135196 | A1 * | 7/2019 | G10H 3/187 |

* cited by examiner

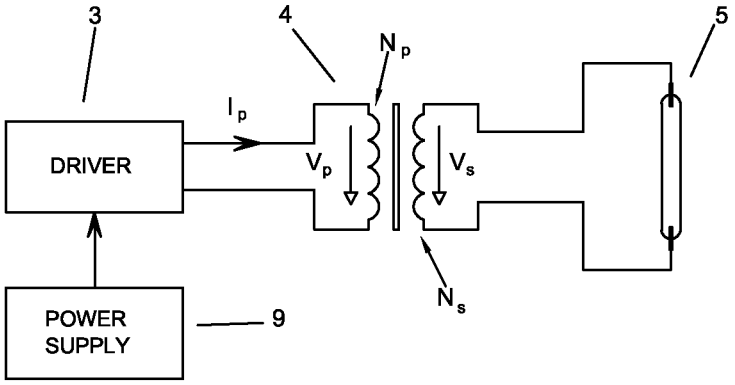
Fig. 3
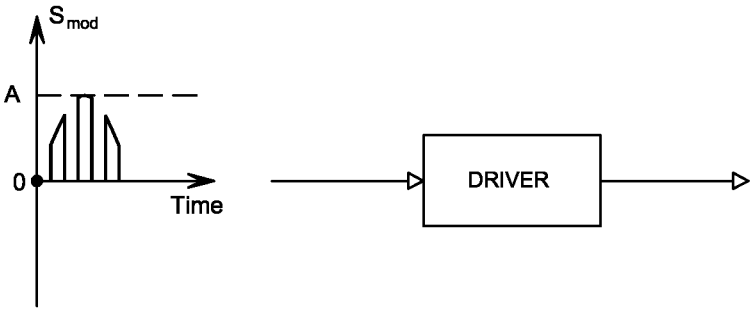
Fig. 4.1
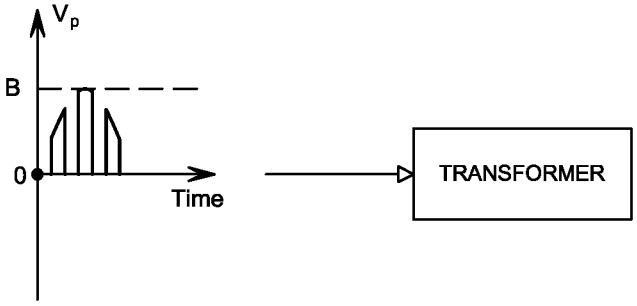
Fig. 4.2

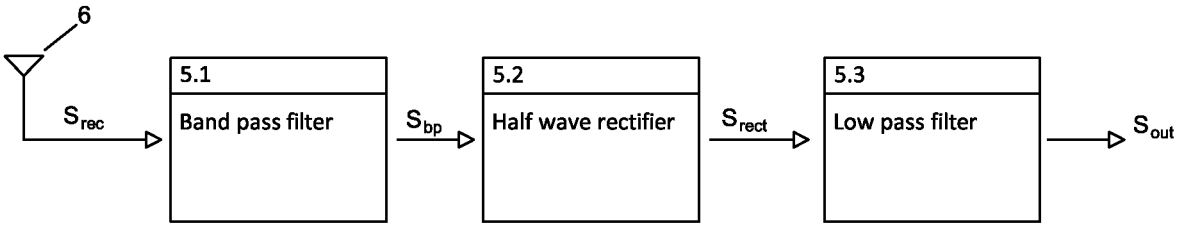
Fig. 5
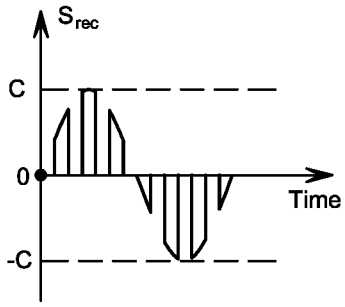
Fig. 6.1
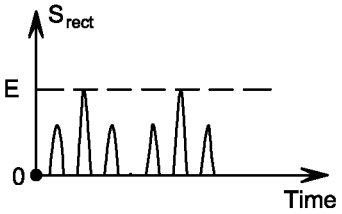
Fig. 6.3
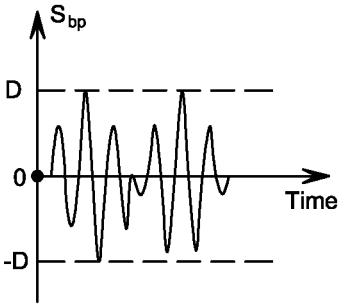
Fig. 6.2
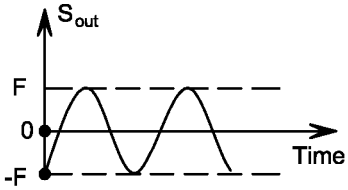
Fig. 6.4

ELECTRONIC EFFECTS DEVICE AND METHOD

TECHNICAL FIELD

This invention relates to the field of musical instrument technology and in particular to electronic effects devices.

BACKGROUND

Currently, nearly all musicians who play live or record music incorporate electronic effects devices in their performance in some way. Such electronic effects devices can be used to enhance the sound possibilities of any instrument type, including acoustic and electric string instruments, wind instruments, percussion instruments and vocals. The most common users of such effects devices are guitarists, electric guitar in particular, and there is a large variety of electronic effects devices available for guitars.

In most cases, effects devices for guitar are designed as separately powered devices, activated by foot-operated switches or pedals, and are placed in the signal path between the instrument and the amplification or recording equipment.

Arguably, the most popular class of effects devices, known as "overdrive", "distortion", "fuzz" etc., are designed to distort, degrade or clip the audio signal from an electric musical instrument. Such effects devices are widely used in popular music, the most common application being for use with electric string instruments.

Historically, overdrive and distortion effects have been achieved by amplifying analog audio signals using various electronic components, such as vacuum tubes, series of cascaded diodes or transistors. Some newer effects devices achieve the desired overdrive/distortion effect by means of digital audio signal processing.

The resulting distorted audio signal gives electric stringed instruments a perceived more aggressive and powerful character, as well as saturating the instrument's signal with overtones, even and uneven harmonics, and also increasing the instrument's sustain.

Most standalone musical effects devices use low voltage power and as a result of signal amplification, they tend to bring out and highlight a lot of the instrument's natural noises and hum from electromagnetic pickups. This is almost always an undesirable quality, as it pollutes the audio spectrum thus negatively impacting the instrument's tonal properties and reducing the instrument's dynamic range.

The objective of the invention is to create a new effects device able to produce a new and original audio effect. Another objective of the invention is to create an effects device that is able to suppress undesirable noises from electromagnetic pickups at high gain settings.

SUMMARY OF THE INVENTION

The proposed device achieves a distorted sound, by transforming the instrument's audio signal into a continuous series of high-voltage discharges inside a gas-filled tube. These discharges produce visible bursts of plasma that reflect the frequencies and rhythm patterns played by the musician, or triggered by the audio source. These plasma discharges cause precise impulses in the surrounding electromagnetic field, which can then be picked up by an antenna or a special receiver unit, and converted into low voltage analog audio signal.

The resulting musical effect is a very heavily distorted signal with many additional tonal and harmonic characteristics that occur as a by-product of the plasma discharges. This particular tonal character may be considered an advantage among many musicians, depending on artistic preferences.

Furthermore, the proposed device is very efficient at resisting noise and hum at times when the musician is not playing (in between musical bars or rhythmical patterns), thus allowing for greater dynamics and more detailed control over the instrument at high volumes. Such resistance to lower level signals is occasionally used as a standalone effect, called "noise-gate". The principle is that all audio signal below a certain threshold is blocked.

As a result—only a relatively strong audio signal, such as a strummed chord or single note, is necessary to induce the plasma discharge within the gas-discharge tube. At all other times, when the instrument is not being intentionally played or during a musical pause, the audio signal produced by the instrument is usually minuscule (hum, accidental noises) and therefore not strong enough to cause the plasma discharge.

During these periods the gas-discharge tube will not produce any visible plasma, and therefore the electrical chain will be interrupted. When the electrical chain is interrupted no audio signal will be produced and sent to the amplification system, resulting in almost instant silence.

In one aspect the invention is an electronic effects device for a musical instrument comprising: an input circuit for receiving an input audio signal, a gas discharge tube in communication with the input circuit, and an output circuit in communication with the gas discharge tube for converting the gas discharge into an output audio signal. The input circuit also comprises a transducer for converting the input signal into a signal suitable for producing a discharge in the gas discharge tube.

Preferably, the device comprises a transformer included into the input circuit and connected to the gas discharge tube.

Advantageously, the output circuit of the device comprises an electro-magnetic antenna adapted to receive an electro-magnetic signal produced by the discharge in the gas discharge tube, and a detector for converting the signal received by the antenna into an audio output signal.

Alternatively, the output circuit may comprise an optical sensor adapted to produce an electric signal from the discharge in the gas discharge tube. Another alternative may be that the output circuit comprises an output transformer adapted to produce an electric signal corresponding to the gas discharge in the gas discharge tube.

Preferably the input circuit of the device comprises a pulse-amplitude modulation module.

In the preferred embodiment, the device further comprises a pulse-amplitude modulation module and a transformer in the input circuit, and an electro-magnetic antenna and a detector in the output circuit.

In another aspect the invention is a method for producing an electronic effect for musical instruments comprising the following steps:

a. receiving an input audio signal;
b. transforming the input audio signal into a signal suitable for producing a discharge in a gas discharge tube;
c. feeding the transformed signal to the gas discharge tube;
d. converting the discharge in the gas discharge tube into an output audio signal.

Preferably the step of transforming the input audio signal includes modulating a high-frequency carrier signal with the input audio signal.

Preferably the step of transforming the input audio signal further comprises feeding the modulated signal to a high-voltage transformer.

Preferably the step of converting the discharge in the gas discharge tube into output audio signal comprises receiving an electro-magnetic signal produced by the discharge.

DESCRIPTION OF THE DEVICE'S EMBODIMENT

The proposed device may be configured in multiple ways, including as a standalone foot-operated pedal, a rack-mountable or table-top unit or even it can be integrated into a larger audio playback or processing device, such as a power amplifier, speaker, or combo amplifier.

Generally, the proposed device comprises an input circuit for receiving an input audio signal, a gas discharge tube in communication with the input circuit, and an output circuit in communication with the discharge tube for converting the gas discharge into an output audio signal. The input circuit also comprises a transducer for converting the input signal into high-voltage signal suitable for producing a discharge in the gas discharge tube.

Figure 1:
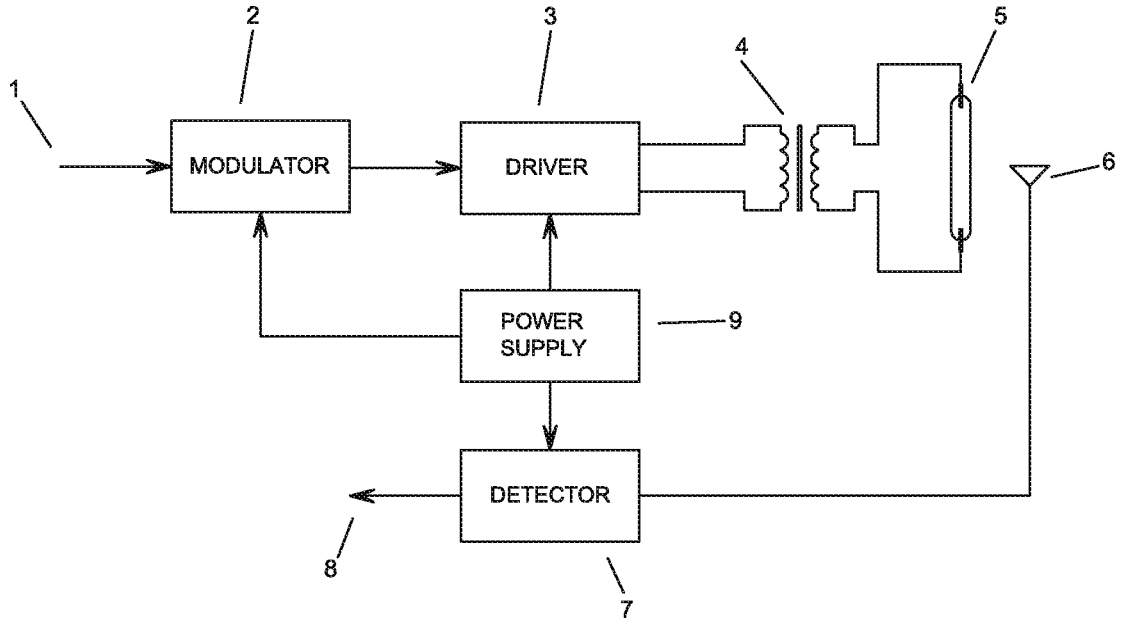
FIG. 1 General electronics block-diagram
FIG. 2 Pulse Amplitude Modulation
FIG. 3 Driver, Transformer and Gas discharge tube
FIG. 4.1, 4.2 Transformer Primary voltage $V_p$
FIG. 5 Detector block-diagram
FIGS. 6.1-6.4 Signal demodulation
FIG. 7 Low pass filter

In an embodiment shown in FIG. 1 the input circuit of the effects device includes a modulator 2 that receives an input signal 1 and transforms it into modulated high-frequency signal, the driver 3 to amplify the modulated signal, and the transformer 4 that converts the amplified signal into a high-voltage signal required to produce a discharge in the gas discharge tube 5. The device further comprises an antenna 6 for receiving an electro-magnetic signal produced by the discharge in the gas discharge tube 5, and the detector 7 that receives the signal from the antenna 6 and produces from it the output signal 8. All elements of the device are powered by a constant current power supply 9.

Visible Gas-Discharge Tube

In the preferred embodiment of the invention, the gas-discharge tube is aligned with a special cut-out window in the device's top-panel. There is a see-through glass cover above the gas-discharge tube, as well as a metallic wire mesh. This is to protect the gas-discharge tube, while enabling the user to observe the plasma light-effect that occurs, as audio signal is passing through the tube.

In the current embodiment of the invention, the device uses a single xenon-filled gas discharge tube that emits blue light, however in alternate embodiments of the device, any number of gas-filled tubes of different shapes and sizes may be utilized.

In this embodiment the device is configured as a foot-operated pedal, housed in a sturdy metallic construction. The metallic construction serves multiple purposes:

Firstly, it gives the unit mechanical strength and protects the electronics against physical impact, such as operating an on/off switch with one's foot.

Secondly, the metallic casing serves as an electromagnetic shield that protects surrounding electronic devices from electromagnetic interference.

The device features multiple ¼ inch jacks for connecting to the instrument/audio source and the recording/playback devices via multiple ¼ inch mono jacks. The currently preferred embodiment of the invention is capable of processing mono signal only, and therefore no stereo input jacks are used. However, a stereo input jack may be featured in a further embodiment of the device together with a built in Stereo-to-Mono mixdown block. In alternative embodiments of the device, the signal may be transmitted in any other suitable way, including 3.5 mm jacks, USB cables, blue-tooth or other wireless methods.

The device features multiple rotary potentiometers accessible on the unit's top panel. These potentiometers may be used to control and adjust the various parameters of the wet signal produced by the device, such as volume, tone and timbre, amount of distortion, the intensity of the gas-discharge tube etc.

Any other type of controllers, slider switches, tumbler switches, potentiometers and selectors may also be used instead of or in tandem with the rotary potentiometers, in order to adjust the parameters of the WET or DRY signals produced by the device.

The device is activated by means of a foot-operated two-position on/off switch, however different kinds of switches may be used to engage or disengage the effect as needed, including levers, latching and non-latching buttons, gradual controllers etc.

Detailed Description of the Signal Path and Individual Electronic Blocks.

Input Audio Signal

The device receives an analog audio signal ($S_{in}$) from any audio source, such as an electro-magnetic pickup, piezo pickup, microphone, or a mono or stereo playback device. In the preferred embodiment the device receives audio signal via a ¼ inch mono jack input. In most cases, such as the output from magnetic pickups, the audio signal varies between 100 mV rms to over 1 V rms for some of the higher output types. Audio signal is received by the modulator block (see section "Modulator Block"), where it is prepared (modulated) to ensure optimal performance of the voltage boost transformer (see section "Voltage boost transformer").

Modulator Block

Before feeding the audio signal into a voltage boost transformer the audio signal must be modulated with a certain carrier frequency, suitable for the transformer.

This is necessary because most transformers are not able to operate efficiently at the audio frequency range.

The input audio signal ($S_{in}$) is modulated using an integrated timer circuit such as the 555 timer IC, or any similar timer or other oscillator. In the currently preferred embodiment of the invention a pulse amplitude modulation (PAM) with a square-wave carrier signal is used, as demonstrated in FIG. 2. The waveform of the signal $S_{car}$ can also be a triangle, sine, saw tooth and other shapes with a period $T_{car}$.

The modulator block can be modified to achieve both positive and negative pulses (ranging from level [−A . . . A], FIG. 2), or to produce only positive half periods of the signal $S_{mod}$ (ranging from [0 . . . A], FIG. 2), or only negative half periods of the signal $S_{mod}$ (ranging from [−A . . . 0], FIG. 2).

Figure 2:
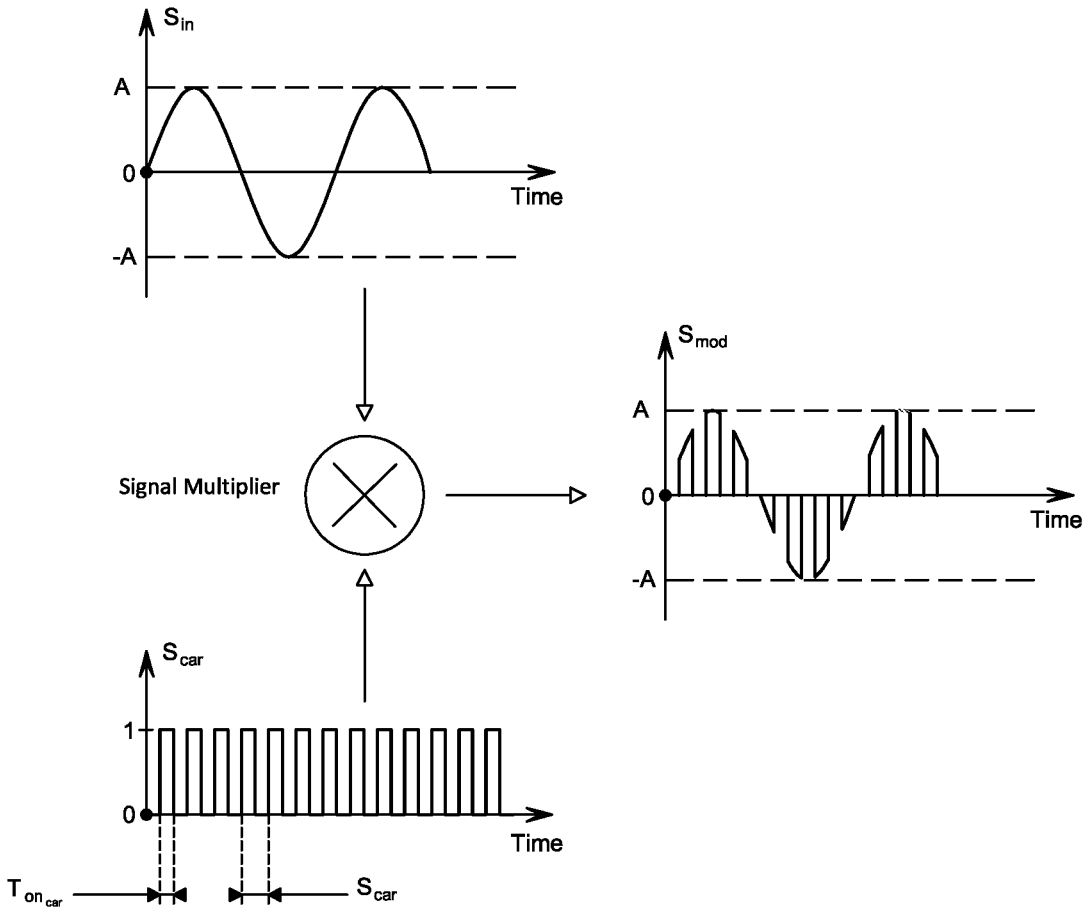

FIG. 2 demonstrates the currently preferred method of modulation, where the basic modulated signal $S_{mod}$ is the product of signals $S_{in}$ and $S_{car}$ with an amplitude A.

$S_{in}$—input signal
$S_{car}$—carrier signal
$T_{car}$—period of the carrier signal
$T_{on_{car}}$—carrier signal pulse duration
$S_{mod}$—modulated output signal Multiple alternative methods of modulation can be used, but the main reasons why Pulse Amplitude Modulation is used in the preferred embodiment of the device are:

1) When $S_{in}$ is not present, there is no $S_{mod}$

When the input signal level is so low that it is considered as silence, the driver block (FIG. 1; Section "Driver block") does not feed any significant voltage to the primary winding of the transformer (FIG. 1.; Section "Voltage boost Transformer"). As a result, electric discharges do not occur within the gas-discharge tube (FIG. 1.; Section "Gas Discharge tube").

In an ideal case the relation between both signals is as follows:

$$S_{mod}=S_{in}S_{car} \tag{1}$$

2) $T_{car}$ and $T_{on_{car}}$ is adjusted to match the nominal frequency of the transformer to ensure the optimal performance of the transformer with reduced energy loss. $T_{on_{car}}$ is also adjusted to not exceed the transformer's saturation current. The larger the duty cycle of the carrier signal $S_{car}$, $$D_{S_{car}} = \frac{T_{on_{car}}}{T_{car}} \tag{2}$$

the more energy is delivered to the transformer's primary winding. $T_{car}$ and $T_{on_{car}}$ are adjusted so that the device's total consumed power is compatible with standard power supplies used in musical equipment, which are typically 9V DC, capable of delivering between 200 mA-2 A of current, or more.

The frequency of the carrier signal is defined as:

$$f_{car} = \frac{1}{T_{car}}, \tag{3}$$

The carrier frequency $f_{car}$ may be set at any frequency higher than the proposed device's audible frequency range—for example at 20 kHz or higher (providing that the transformer and driver are capable of operating at such a frequency).

Driver Block

The driver block's purpose is to interrupt current flow from the device's power source to the transformer's primary winding, based on the modulated waveform $S_{mod}$ (FIG. 3).

Thus, it converts $S_{mod}$ into a higher-power signal which is sent to the transformer's primary winding $V_p$ (FIG. 4).

This can be achieved by using a number of transistors (Darlington, MOSFET, BJT, etc.) or other driving integrated circuits.

In all cases multiple topologies may be utilized, such as push-pull, half bridge, full bridge, low-side single transistor, high-side single transistor, and others.

The currently preferred embodiment of the device uses a low-side single transistor to drive the audio signal, however other types of transistors may be used to achieve the desired effect.

$V_P$—Primary voltage (Voltage at the transformer's primary winding)

$V_s$—Secondary voltage (Voltage at the transformer's secondary winding)

$I_P$—Current in the transformer's primary winding $n_P$—transformer's primary winding count $n_s$—transformer's secondary winding count Voltage Boost Transformer The transformer converts primary voltage $V_p$ (electrical pulses at a specifically chosen carrier frequency $f_{car}$, as described above in section "Modulator block") into secondary voltage $V_s$.

In the preferred embodiment a voltage boosting transformer, such as a fly-back transformer or similar is used. Other transformer types can be used in further embodiments of the device.

The transformer and its core must be suitable for efficient voltage transformation at the chosen carrier frequency $$\left(f_{car} = \frac{1}{T_{car}}\right),$$

for example at 20 kHz or another frequency higher than the proposed audio device's audible frequency range.

The secondary winding count $n_s$ must be larger than the primary winding count $n_p$ so that the transformer's secondary voltage $V_s$ is larger than the breakdown voltage in the gas discharge tube (see section "Gas discharge tube"). This ensures an electric discharge in the gas discharge tube.

As continuous low-voltage audio signal is transformed into high-voltage pulses, a significant amount of wide-band noise is produced in the transformer.

This method of audio processing may be considered similar to distortion, as it is associated with a large amount of compression, noise pollution and other types of timbral and harmonic saturation.

Gas Discharge Tube

In the preferred embodiment of the device, the high-voltage electrical pulses created by the transformer are transmitted through a gas discharge tube. The gas discharge tube is a sealed glass cylinder that houses a pair of remote electrodes surrounded by a gas filling (such as argon, neon, krypton, xenon or their mixtures (e.g. Penning mixture) or other gasses and their mixtures typically used in gas discharge tubes).

In this environment, the applied high-voltage pulses that are larger than the breakdown voltage of the gas within the gas discharge tube create bursts of electric discharges, producing plasma channels. As a result of gas ionization, a portion of the electric current is converted into visible bursts of light inside the gas-discharge glass tube. These bursts of light (plasma channels) correspond with the audio signal produced by the musician, thus acting as a visualization for any notes or chords being plucked, strummed, etc.

The resulting electromagnetic activity surrounding the gas discharge tube can be detected or picked up by using an antenna (see section "Antenna") and then filtered and demodulated (see section "Detector") to produce a useable audio signal sent to the device's output.

Additionally, during the gas discharge process, a certain amount of both acoustical and electromagnetic wide-band noise may be produced, for example, "popping" or "crackling" noises that occur during the gas-discharge; such added noises may be considered aesthetically pleasing to the performer and/or listeners.

It should be noted, that there may be alternative embodiments where the gas discharge tube is replaced by an exposed spark gap (two separate electrodes surrounded by air). Using a spark gap instead of a gas discharge tube would significantly increase the amount of "popping" and "crackling" noises generated by the device. Such noises may be picked up by the device's antenna and detector blocks. If necessary the device could also be modified with an additional microphonic unit (or a special pickup) to harvest the acoustic waves created by the electric discharges inside the spark gap.

Antenna

In the preferred embodiment of the device a conductive element, or antenna, such as a wire or rod, may be used to pick up the activity in the electromagnetic field surrounding the gas discharge tube, generated by the electrical discharges in the gas discharge tube.

In the preferred embodiment of the device, the antenna is mounted on the inside of the device—near the gas discharge tube or it's connection wires. The antenna is mounted as close as necessary to pick up the electromagnetic radiation emitted by the gas discharge process, yet precise placement may vary depending on the user's preferences.

When electric discharge occurs, the antenna intercepts some of the power of the radiated electromagnetic wave in order to produce an electric current at the antenna's terminals. This signal is then processed by a detector and further amplified (see section "Detector").

Other electromagnetic pickup types can be used to feed the signal to the detector, such as a magnetic pickup, current transformer etc., placed near the connections of the gas discharge tube or at its connection wires.

Detector

A specifically designed detector unit may be used to filter and de-modulate the electric signal $S_{rec}$ (FIG. 6.1) picked up by the antenna (or other pick-up types), in order to generate a usable audio signal $S_{out}$ (FIG. 6.4).

The Detector consists of three blocks: Band pass filter, Half wave rectifier and Low pass filter, as shown in FIG. 5, wherein:

$S_{rec}$—electric signal picked up by the antenna (or other pick-up types)

$S_{bp}$—band pass filtered signal $S_{rect}$—rectified signal $S_{our}$—usable audio signal (post low pass filter).

Band Pass Filter

The band pass filter's center frequency $f_c$ is tuned to match the frequency of the carrier signal $$f_{car} = \frac{1}{T_{car}} \tag{4}$$

In FIG. 6.1. the received signal from antenna $S_{rec}$ is converted to signal $S_{bp}$ FIG. 6.2.

Half Wave Rectifier

To recreate the input signal $S_{in}$ a half wave rectifier is used and signal similar to $S_{rect}$ is generated, FIG. 6.3.

Low Pass Filter

Figure 7:
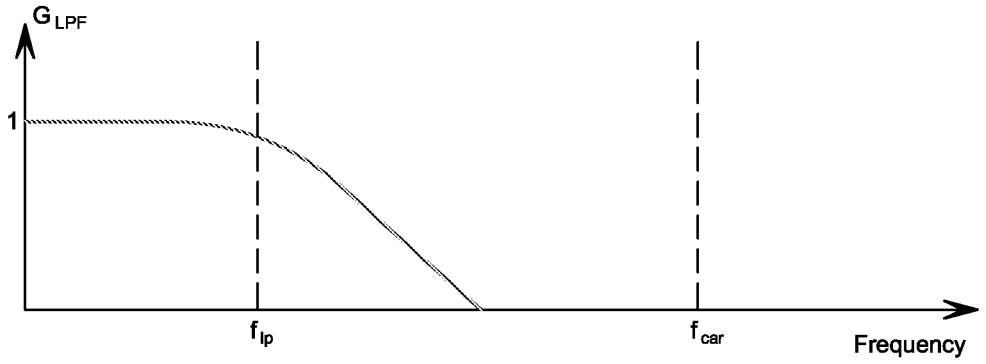

The low pass filter's cut-off frequency $f_{lp}$ must be lower than $f_{car}$ (see FIG. 7):

$$f_{lp} < f_{car} \tag{5}$$

in order to recreate the input signal $S_{in}$.

$f_{lp}$ can be further adjusted to change the tonal, timbral etc., properties of audio signal $S_{out}$ (FIG. 6.4) before sending it to the device's output.

Output Signal

The output signal is the product of the whole electronic chain described in this document, and it is also subject to tonal and timbral change depending on the component types and values used in all of the described blocks.

Due to the non-linear nature of the driver, transformer and other components, added higher series of harmonics may be found in the output signal. There may also be cases of added "popping" or "crackling" noises that occur during the gas-discharge. These added qualities may be considered aesthetically pleasing to the performer and or listener.

The invention claimed is:

1. An electronic effects device comprising:

an input circuit for receiving an input audio signal;

a gas discharge tube in communication with the input circuit;

wherein the input circuit comprises a transducer for converting the input signal into a signal suitable for producing a discharge in the gas discharge tube;

an output circuit in communication with the gas discharge tube for converting the gas discharge into an output audio signal.

2. The device according to claim 1, further comprising a transformer included into the input circuit and connected to the gas discharge tube.

3. The device according to claim 1, wherein the output circuit comprises an electro-magnetic antenna adapted to receive an electro-magnetic signal produced by the discharge in the gas discharge tube.

4. The device according to claim 3, wherein the output circuit further comprises a detector.

5. The device according to claim 1, wherein the output circuit comprises an optical sensor adapted to produce an electric signal from the discharge in the gas discharge tube.

6. The device according to claim 2, wherein the output circuit comprises an output transformer adapted to produce an electric signal corresponding to the gas discharge in the gas discharge tube.

7. The device according to claim 1, wherein the input circuit comprises a pulse-amplitude modulation module.

8. The device according to claim 1, wherein the input circuit comprises a pulse-amplitude modulation module and a transformer, and the output circuit comprises an electro-magnetic antenna and a detector.

9. A method for producing electronic effects for musical instruments comprising the following steps:

a. receiving an input audio signal;

b. transforming the input audio signal into a signal suitable for producing a discharge in a gas discharge tube;

c. feeding the transformed signal to the gas discharge tube;

d. converting the discharge in the gas discharge tube into an output audio signal.

10. The method of claim 9 wherein the step of transforming the input audio signal comprises modulating a high-frequency signal with the input audio signal.

11. The method of claim 10 wherein the step of transforming the input audio signal further comprises feeding the modulated signal to a high-voltage transformer.

12. The method of claim 9 wherein the step of converting the discharge in the gas discharge tube into the output audio signal comprises receiving an electro-magnetic signal produced by the discharge.

* * * * *